US010920383B2

(12) United States Patent
Annan et al.

(10) Patent No.: US 10,920,383 B2
(45) Date of Patent: Feb. 16, 2021

(54) CABLE ANCHORAGE SYSTEM

(71) Applicant: VSL International AG, Berne (CH)

(72) Inventors: Rachid Annan, Rapperswil (CH); Ludovic Louis Michel, Lausanne (CH)

(73) Assignee: VSL INTERNATIONAL AG, Berne (CH)

( * ) Notice: Subject to any disclaimer, the term of this patent is extended or adjusted under 35 U.S.C. 154(b) by 142 days.

(21) Appl. No.: 15/754,967

(22) PCT Filed: Aug. 31, 2015

(86) PCT No.: PCT/EP2015/069860
§ 371 (c)(1),
(2) Date: Feb. 23, 2018

(87) PCT Pub. No.: WO2017/036514
PCT Pub. Date: Mar. 9, 2017

(65) Prior Publication Data

US 2019/0338475 A1 Nov. 7, 2019

(51) Int. Cl.
*E01D 19/14* (2006.01)
*E04C 5/12* (2006.01)
*E04H 12/20* (2006.01)

(52) U.S. Cl.
CPC ..... *E01D 19/14* (2013.01); *E04C 5/125* (2013.01); *E04H 12/20* (2013.01)

(58) Field of Classification Search
CPC ..... E01D 19/14; E04C 5/125; E04H 12/20; F16B 43/02; F16B 5/025
(Continued)

(56) References Cited

U.S. PATENT DOCUMENTS 1,172,145 A * 2/1916 Lacerda ..... F22B 7/16 411/370
1,399,942 A * 12/1921 Dowd ..... 411/376
(Continued)

FOREIGN PATENT DOCUMENTS

WO 2000056994 A1 9/2000

OTHER PUBLICATIONS

International Search Report and Written Opinion issued in corresponding PCT application No. PCT/EP2015/069860 dated May 3, 2016, 10 pages.

*Primary Examiner* — Christopher Garft
(74) *Attorney, Agent, or Firm* — Pearne & Gordon LLP

(57) ABSTRACT

A cable anchorage system for anchoring a cable to a support structure in a civil engineering construction comprises an anchorage socket attached to the cable, a support socket attached to the support structure and a longitudinal coupling rod, which couples the anchorage socket to the support socket. The coupling rod comprises a threaded end, which interacts with a counter thread on one of the two parts which are the anchorage socket and the support socket, and a mounting end with a radially extending rod shoulder. The other one of the two parts which are the anchorage socket and the support socket comprises a longitudinal opening for receiving the mounting end of the coupling rod, which opening comprises an inwardly extending abutment shoulder. The rod shoulder abuts on the abutment shoulder in a first longitudinal direction and is slideable within the opening in a second longitudinal direction opposite to the first direction, when the anchorage socket is moved towards the support socket for tuning the cable anchorage system.

14 Claims, 3 Drawing Sheets

Figure 1:
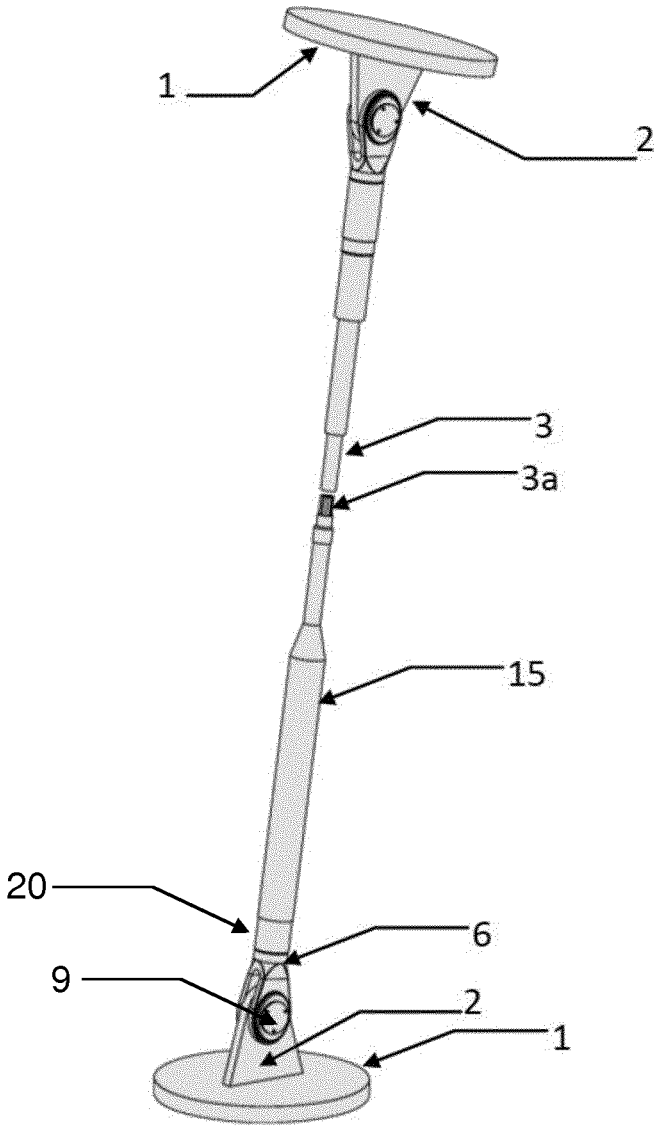

(58) Field of Classification Search
USPC ..... 411/537, 399, 379–380; 14/22; 248/500
See application file for complete search history.

(56) References Cited

U.S. PATENT DOCUMENTS 1,498,019 A * 6/1924 Dodds ..... F22B 7/16 411/374
2,930,091 A * 3/1960 Imparto ..... F16B 5/025 24/287
3,318,622 A * 5/1967 Crumpler ..... F16B 5/025 403/66
3,327,380 A 6/1967 Howlett
3,382,630 A * 5/1968 Chivers ..... B64C 1/149 52/208
3,405,490 A * 10/1968 La Marr ..... E04C 5/125 52/223.13
4,127,037 A * 11/1978 Weaver ..... G05G 1/56 411/380
4,202,242 A * 5/1980 Champoux ..... E06B 3/5436 403/56
5,534,032 A * 7/1996 Hodorek ..... A61F 2/389 623/20.32
6,681,431 B2 1/2004 Zivanovic et al.
6,694,687 B2 * 2/2004 Elmer ..... E04B 3/5436 403/367
7,118,317 B2 * 10/2006 Hofschneider ..... B60B 3/16 411/402
7,603,820 B1 * 10/2009 Lai ..... E06B 3/5436 403/56
2001/0021851 A1 * 9/2001 Eberlein ..... A61B 17/804 606/287
2002/0104175 A1 * 8/2002 Zivanovic ..... E01D 19/16 14/22
2005/0079012 A1 * 4/2005 Mochizuki ..... F16L 21/065 403/408.1
2017/0218988 A1 * 8/2017 Piccolo ..... F16B 5/025

* cited by examiner

CABLE ANCHORAGE SYSTEM

The present invention relates to an anchoring system for cable anchorages e. g. for civil engineering structures, particularly with regard to the field of cable technology using a clevis type anchorage.

Many civil engineering structures are based on stay cable or cable hanger technology using a configuration or framework assembled of a plurality of cable strands. The technology for example enables the design of major suspension bridges, arch bridges or cable stayed bridges with long spans, wide span roof structures or stayed masts or towers. For the construction of such civil engineering structures stay cables or cable hangers are used, which are anchored on both ends between supports of the structure and subjected to tensile forces to absorb the load of the structure. Often clevis type anchorages are used to attach the cable to the support, wherein the cable is fixed in a cable block, which in turn is fixed to a clevis unit mounted on the support by a thread connection. Such a cable anchorage is shown in WO 00/56994 for example.

The length and the tension of the cables have to be adjusted to achieve the desired geometry of the civil engineering structure. In particular the cables have to be tensioned after their first fixation between the supports of the structure. In general this is a difficult undertaking because of the extreme weight of the cables, the high loads and forces that apply and the overall size of the anchorage and structure.

In U.S. Pat. No. 6,681,431 B1 an adjustable anchor bearing for a suspension bridge is shown comprising a hanger, which is attached to an anchor pipe fixed adjustably to a deck of the bridge. The anchor bearing allows to adjust the length of the hanger in order to respect the predetermined geometry of a suspension cable of the bridge. A longitudinal linking part with male threads on both ends is provided to connect the anchor pipe with the hanger to a clevis, which is connected to a support of the deck. The thread connections between the linking part and the anchor pipe as well as the linking part and the clevis are realized with a play. The clevis comprises two flanges enclosing the support on both sides. A horizontal pin extends through oblong holes in the flanges and hole in the support. The oblong holes are elongated in the longitudinal direction of the hanger to provide a play between the clevis and the support, when the pin is arranged through the holes of clevis and support. An adjustment tool is provided to bring the anchor pipe closer to the support thus taking up the play that extends initially between the upper end of the oblong holes of the clevis and the pin. Thus the adjustable anchor bearing provides some mobility of the hanger in longitudinal direction and articulation around the axis of the pin in order to enable adjustment of the linking part during installation. But it does not allow any movement in any other direction and a rotation around the longitudinal hanger axis between the anchor pipe and the clevis is only possible via the thread connections of the linking part. In particular such an arrangement with three degrees of freedom does not provide any rotational capacity around an axis perpendicular to the axis of the pin and perpendicular to the longitudinal axis of the hanger.

It is an object of the present invention to overcome this and/or other disadvantages of prior art anchorages. In particular it is an object of the present invention to simplify the installation and tuning of a cable in civil engineering structures, to limit parasite stresses in case of misalignment of the cable, and to provide safe and long lasting cable anchoring for in civil engineering structures.

The invention therefore envisages a cable anchorage system, a civil engineering construction, and a method for tuning a cable anchorage system. Advantageous examples of the invention are set out in the claims.

A cable anchorage system for anchoring a cable to a support structure, that is part of a civil engineering structure or can be integrated into a civil engineering structure, comprises an anchorage socket attached to one end of the cable, a support socket attached to the support structure and a longitudinal coupling rod, which couples the anchorage socket to the support socket. The support socket can be attached to the support structure directly or by a further coupling device, for example a clevis coupler. Basically the coupling rod can be provided by a cylindrical, elongated element. Preferably the coupling rod has a cylindrically symmetric configuration. The anchorage socket can retain the cable and the cable strands respectively at one end in commonly known fashion. The other end of the anchorage socket may be sleeve-like with an inner hollow or opening for receiving one end of the coupling rod. The support socket likewise may be partially sleeve-like with an inner hollow or opening for receiving the other end of the coupling rod. The sleeve like elements of the anchorage socket and/or the support socket may further be independent elements threaded onto the anchorage socket and/or the support socket.

The cable anchorage system may provide at least four degrees of freedom in the anchoring system with free rotations around the three perpendicular axis at least at the time of installation.

For coupling the anchorage socket with the cable attached thereto with the support socket, the coupling rod comprises a threaded end and a mounting end opposite to the threaded end. The threaded end interacts with a counter thread on one of the two parts which are the anchorage socket and the support socket. Thus the counter thread can be provided either on the anchorage socket or on the support socket. The other one of the two parts which are the anchorage socket and the support socket comprises a longitudinal opening for receiving the mounting end of the coupling rod. The opening can be a hole, that extends from the receiving end of the respective socket along the longitudinal axis within the socket. The mounting end of the coupling rod comprises a radially extending rod shoulder. The opening comprises an inwardly extending abutment shoulder on an inner contour of the opening. The rod shoulder abuts on the abutment shoulder in a first longitudinal direction and is slideable within the opening in a second longitudinal direction opposite to the first direction. The longitudinal direction basically corresponds to the longitudinal axis of the opening and the one of the two parts which are the anchorage socket and the support socket comprising the opening. Thus the coupling rod is supported in the opening with some clearance or play in longitudinal direction. The length of the clearance for the coupling rod in the second longitudinal direction may be limited by the blocking of the anchorage socket on the support socket for example. Alternatively a further abutment may be provided at the opening to block the end of the mounting end of the coupling rod.

When installing and stressing a cable of a civil engineering structure with the cable anchorage system according to the invention, the moveable unit of anchorage socket and cable can be aligned easily relative to the mostly stationary unit of support socket and support structure. During this procedure of tuning the cable the coupling rod connecting the support socket to the anchorage socket can slide within the opening. Therefore the coupling rod can move freely to enable its engagement when the anchorage socket is moved closer to the support socket in a simple and reliable fashion. Advantageously the coupling rod is received within the opening in a rotatable fashion about the longitudinal axis of the opening. Thus the anchorage system can be engaged without having to rotate one or both of the two sockets relative to the support structure or the cable around the longitudinal axis of the cable, while installing and tuning the cable in the civil engineering structure.

For example the mounting end of the coupling rod and the opening are rotationally symmetric. For example the radially extending rod shoulder of the mounting end of the coupling rod runs circumferentially around an outer contour of the coupling rod. Alternatively or additionally the inwardly extending abutment shoulder runs circumferentially around an inner contour of the opening. In another example the radially extending rod shoulder or the abutment shoulder can be realized by several rips or fins extending from the circumference of the rod or the opening respectively. The rips or fins can slide on a surface of the opposing shoulder, when the anchorage socket is rotated relative to the support socket. Alternatively the rod shoulder can be designed as a separate rod shoulder element, which is attached to the coupling rod for example by a threaded connection. Thus, the rod shoulder element can be adjusted on the coupling rod according to the specific requirements of a cable and the civil engineering construction.

In one embodiment of the cable anchorage system according to the invention the coupling rod is supported within the opening in a slewable fashion relative to the longitudinal axis of the opening. That means the coupling rod can be pivoted from a position along the longitudinal axis to a position angled to the longitudinal axis, wherein the swivel axis preferably is located somewhere in the mounting end of the coupling rod. This introduces two additional degrees of rotational freedom, thus for example the anchorage system of the cable can be engaged with more mobility during the process of installation of the cable, because the coupling pin can be tilted in any direction allowing to align the axis of the coupling pin tangentially to the axis of the cable at the location of the anchorage socket. The alignment and fit-up between cable and support socket is hence achieved during the coupling operation at time of installation by utilizing the four degrees of freedom consisting of longitudinal play of the coupling rod relative to at least one of the two sockets, rotation around the longitudinal axis of the cable between the coupling rod and the two sockets and rotation around two axis perpendicular to the cable axis and to each other between the coupling rod shoulder and at least one of the two sockets.

Such an arrangement protects further the cable, its anchorage socket and the coupling rod from bending moments otherwise introduced by misalignment between the two sockets which typically occur as a result of construction tolerances or geometrical mismatches. This is of particular importance as the cable, its anchorage socket or the coupling rod can be easily damaged by excessive stresses occurring by superposition of such undesirable bending effects at time of installation, and the longitudinal and/or transverse forces and bending moments originating from the mechanical actions on the cable during its design life further aggravated by fatigue effects due to fluctuating loads. It is hence of utmost importance to eliminate the occurrence of additional bending stresses as a result of misalignment during installation.

For example a surface of the rod shoulder, that faces a surface of the abutment shoulder, advantageously comprises a convex shape; preferably on a surface all around the circumference of the rod shoulder. Accordingly the surface of the abutment shoulder facing the rod shoulder may comprise a concave shape; preferably on a surface all around the circumference of the inner contour of the opening. The convex surface and the concave surface can easily glide on each other, while the coupling rod is rotated or pivoted within the opening.

The opening, which may be located within the anchorage socket or the support socket, can be divided into a first section on one side of the abutment shoulder and a second section on the other side of the abutment shoulder. The first section extends along the inner contour of the opening from the abutment shoulder towards the mounting end of the coupling rod. That means away from the part comprising the counter thread. The second section extends along the inner contour of the opening from the abutment shoulder towards the threaded end of the coupling rod. That means towards the part comprising the counter thread, when the cable anchoring system is assembled.

In one embodiment of the cable anchorage system the mounting end of the coupling rod may comprises a circumferentially tapered section extending from the rod shoulder to the an end edge of the mounting end located within the opening. Thus the circumference around the rod shoulder is larger than the circumference around the end edge of the mounting end. Alternatively or additionally the first section of the opening can be of conical shape, which opens away from the abutment shoulder and in direction of the mounting end. The tapered section of the mounting end and/or the first conical section of the opening result in a radial gap between the outer contour of the mounting end and the inner contour of the opening. The gap increases towards the end edge of the mounting end. Thus the coupling rod can pivot within the boundaries of this radial gap in any direction. The circumference around the rod shoulder may be only slightly smaller than the circumference of the inner contour of the opening at least in the area adjacent to the abutment shoulder. Thus the coupling rod does not waggle within the first section of the opening. It rather is centered with some play by the abutment shoulder of the opening on the axis of the opening. Therefore the inner contour of the first section of the opening is a longitudinal guide of an outer edge of the rod shoulder, when the coupling rod slides within the opening.

Furthermore the second section of the opening may be of conical shape, which opens in direction of the threaded end of the coupling rod and towards the other part comprising the counter thread respectively. That means the circumference of the opening around the abutment shoulder is smaller than around an end edge of the opening, through which the coupling rod extends out of the opening. The section of the coupling rod starting from the rod shoulder in direction of the threaded end preferably is cylindrically shaped with a constant radius. The threaded area of the threaded end may reach up to the rod shoulder or end in some distance to the rod shoulder resulting in a non-threaded section extending from the rod shoulder. The conical shape of the second section results in a radial gap between coupling rod and the edge of the opening. Thus the coupling rod may be pivoted within the limits of the radial gap. Also the circumference of the abutment shoulder may be only slightly larger than the circumference of the coupling rod in the section between the rod shoulder and the threaded end. Thus the abutment shoulder serves as a guide for the longitudinal sliding of the coupling rod within the opening and the coupling rod is centered within the opening during movement of the coupling rod. Therefore the outer contour of the coupling rod between rod shoulder and threaded end is a longitudinal guide of an inner edge of the abutment shoulder, when the coupling rod slides within the opening.

The cable anchorage system according to the present invention may comprise a stressing unit for moving the anchorage socket towards the support socket. The stressing unit comprises at least one stressing jack, that is attached or can be attached to the anchorage socket, and socket stressing brackets, which are attached or can be attached to the support socket or the pin of a clevis unit connected to the support socket. Stressing elements, e. g. in form of stressing bars, extend between the stressing jacks and the brackets to contract the cable anchorage system.

According to a method for tuning a cable anchorage system the stressing unit moves the anchorage socket towards the support socket. Thus one end of the cable is pulled towards the support structure of the civil engineering construction. Advantageously a force to stress the cable is transmitted from the support socket via the socket stressing brackets and the stressing jacks to the anchorage socket or the clevis pin. Like this, no additional auxiliary attachment elements need to be provided on the civil engineering structure to apply the stressing force.

A cable anchorage system according to the invention enables the anchorage socket holding the cable to move with several degrees of freedom relative to the support socket. First of all it may slide along the longitudinal axis of the anchorage system. Also it can rotate around the axis of the anchorage system. Furthermore it can be tilted in different directions relative to the support socket. While moving the anchorage socket and the support socket towards each other, the mounting end of the coupling rod slide within the opening and is aligned along the longitudinal axis of the opening. This facilitates the installation and tuning of cables in civil engineering constructions like suspension bridges, cable stayed bridges, roof structures, stayed masts or towers or the like. Thus the present invention also refers to civil engineering constructions comprising at least one cable, which is attached to a supporting structure of the civil engineering construction at least on one end by a cable anchorage system as described above.

Figure 2:
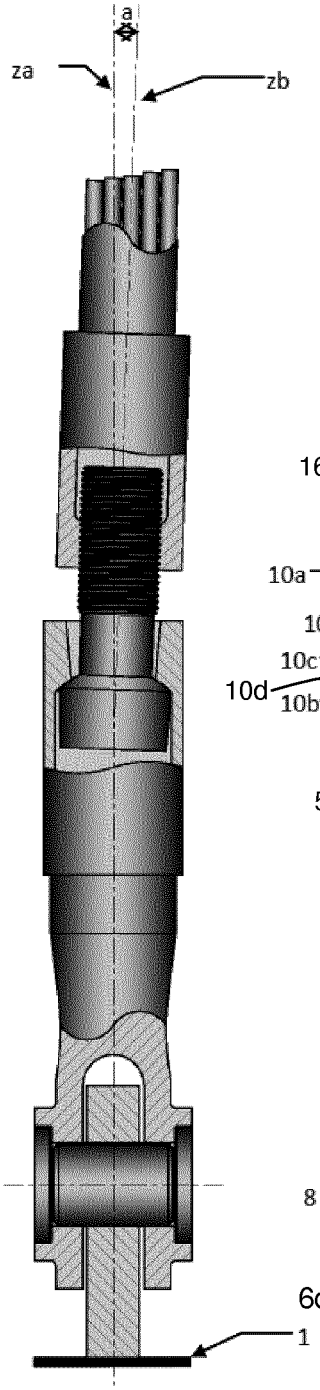
Figure 3:
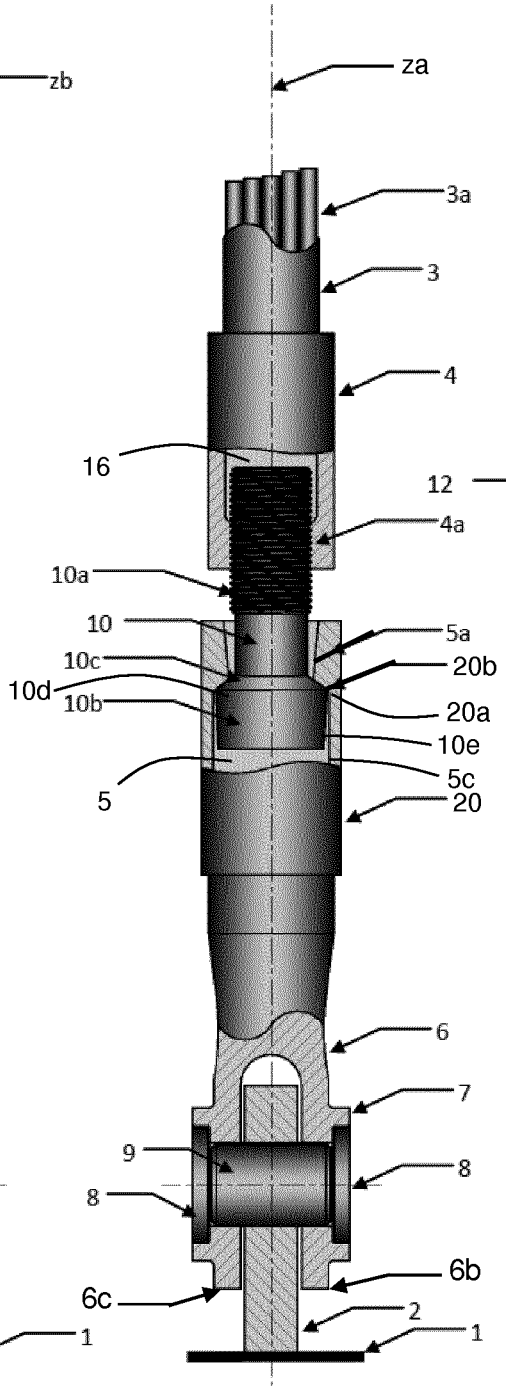
Figure 4:
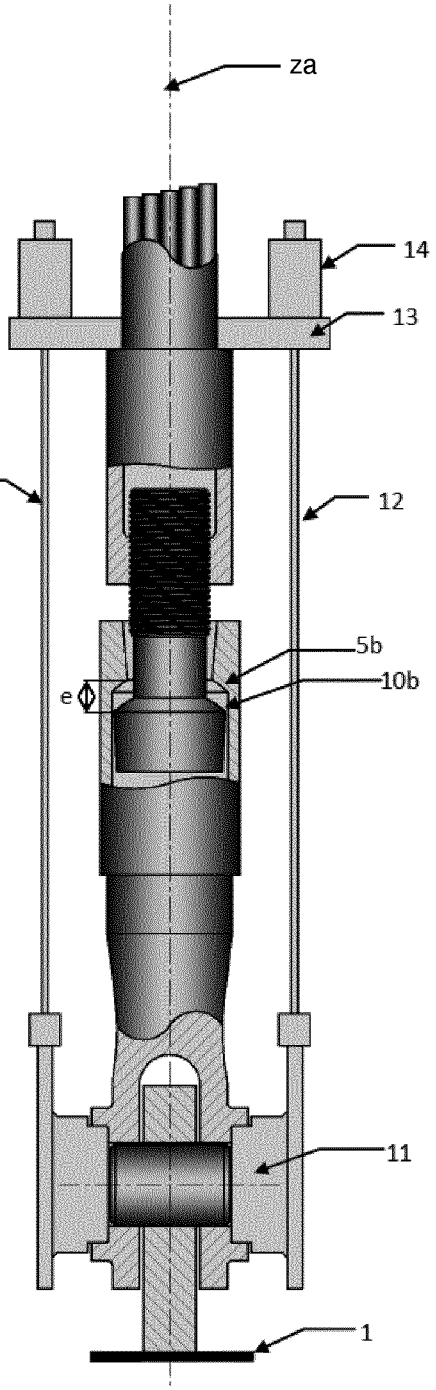
Figure 5:
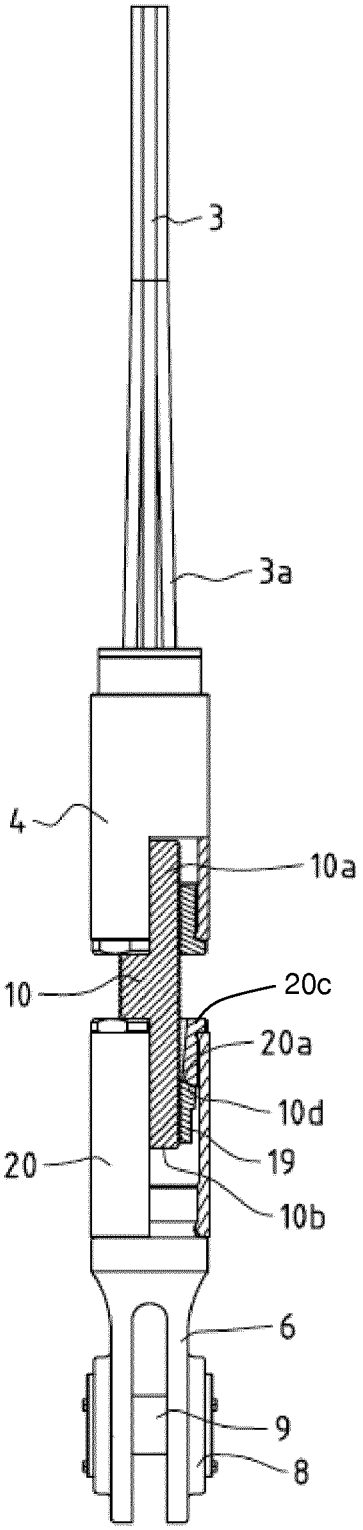

In the following, embodiments of the invention will be illustrated in the drawings, which merely serve for explanation and should not be construed as being restrictive. The features of the invention becoming obvious from the drawings should be considered to be part of the disclosure of the invention both on their own and in any combination. The drawings show:

FIG. 1: a three-dimensional example of a cable stay using a cable anchorage system according to the present invention, FIG. 2: a longitudinal partial sectional view of a cable anchorage system according to the present invention in a first position, FIG. 3: a longitudinal partial sectional view of the cable anchorage system according FIG. 2 in a second position, FIG. 4: a longitudinal partial sectional view of the cable anchorage system according FIGS. 2 and 3 in a third position, FIG. 5: a partial sectional view of a further embodiment of a cable anchorage system according to the invention.

FIG. 1 gives an overview of a stayed cable 3 in a civil engineering construction according to the invention. The cable 3 comprises a cable anchoring system according to the invention on both ends so that the cables is coupled to supporting structures 1 of the civil engineering construction. In the shown example the cable anchorage systems are covered by an anti vandalism pipe 15. The supporting structure 1 can be decks, pylons, arches, main cables in case of suspended bridges or suspended roofs, or any kind of civil engineering or building structure. A support socket 20 of the cable anchoring system is attached to a clevis coupler 6, which is fastened to a gusset flange 2 by a clevis pin 9. The gusset flange 2 is fixed to the support structure 1. The cable 3 can be constituted of one or many cable strands, wires 3*a* (see FIGS. 2-4). Also the cable 3 can be made of one or several rigid bar or a locked coil cable or an equivalent linear element. The anti vandalism pipe 15 provides mechanical protection to the entire cable anchoring system. Optionally the anti vandalism pipe can be mounted air or leak tight to provide high corrosion protection to the cable anchoring system.

FIGS. 2 to 4 show a partially sectional view of the cable anchorage system according to one example in different positions. Generally the cable anchoring system comprises an anchorage socket 4 attached to the cable 3, the support socket 20 attached to the support structure 1 either directly or by connection to a clevis coupler 6 and a clevis pin 9 and a longitudinal coupling rod 10, which couples the anchorage socket 4 to the support socket 20. The cable 3 is anchored in the anchorage socket 4 in commonly known fashion. Opposite to the cable end the anchorage socket 4 comprises a receiving hole 16 with a female thread. The length of the anchorage socket 4 is determined according to the required strength and adjustability for the cable tuning. In one example the length of the receiving hole 16 is up to 500 mm and the female thread has a size as known from the state of the art.

The coupling rod 10 transfers the cable load from the anchorage socket 4 to the support socket 20 and the clevis coupler 6 respectively. The coupling rod 10 has an elongated shape and in this embodiment is a single piece. It comprises a threaded end 10*a* with a male thread, a mounting end 10*b* supported in the support socket 20 and a rod shoulder 10*d* with a rod shoulder surface 10*c*. The female thread of the anchorage socket 4 serves as counter thread 4*a* for the male thread of the threaded end 10. The rod shoulder 10*d* can be monolithically included in the coupling rod 10, or can be made of an additional element, rigidly connected to the coupling rod 10 for example by a thread connection or other connection.

The support socket 20 also has an elongated shape with an opening 5 extending along an axis (za) in the support socket 20. The opening comprises an abutment shoulder 20*a* with an abutment shoulder surface 20*b*, wherein the abutment shoulder 20*a* extends inwardly into the opening 5 from an inner contour of the opening. In this embodiment the abutment shoulder 20*a* can be realized as a circular step or protrusion on the inner contour of the opening 5. The abutment shoulder surface 20*b* faces towards the rod shoulder surface 10*c*. A first section 5*c* of the opening extends from the abutment shoulder 20*a* in direction away from the anchorage socket 4 towards the mounting end 10*b* of the coupling rod 10. A second section 5*a* of the opening 5 extends from the abutment shoulder 20*a* in direction of the anchorage socket 4 towards the threaded end 10*a* of the coupling rod 10. The threaded end 10*a* of the coupling rod 10 at least partially extends from the opening 5.

The support socket 20 can be rigidly connected to the clevis coupler 6. Alternatively it can also be fixed to the clevis coupler by a thread connection for example. The clevis coupler 6 comprises two flanges 6*a* and 6*b* which enclose the gusset flange 2. The pair of flanges 6*a* and 6*b* and the gusset flange comprise through holes for the clevis pin as is commonly known. Furthermore the brackets of the clevis coupler 6 comprise protrusions 7 around or adjacent to the through holes, which define a flange 8 for attachment of a stressing unit for tuning the cable anchoring system.

The coupling rod 10 comprises a circumferentially tapered section 10*b* extending from the rod shoulder 10*d* to the end of the coupling rod 10, which is located within the opening 5. The surface of the tapered section for example can be inclined about 5° to 15° relative to the axis of the coupling rod. An edge of the rod shoulder 20*a* terminates close to the inner contour of the opening in the first section 5*c* or may lay on the contour without pressure. The circumference around the end of the mounting end 10*b* is less than the circumference of around the rod shoulder. The section of the coupling rod extending from the rod shoulder 10*d* towards the threaded end 10*a* is basically cylindrically shaped with the same circumferential size.

The second section 5*a* of the opening 5 is of conical shape, which opens towards the end, through which the coupling rod extends out of the opening 5, i. g. in direction of the threaded end 10*a* of the coupling rod 10. The abutment shoulder 20*a* reaches close to the coupling rod but does not pinch the coupling rod 10. Because of the conical shape, the circumference of the edge of the abutment shoulder is smaller than the circumference at the end of opening 5, where the coupling rod extends of the support socket 20. The first section 5*c* of the opening 5 is cylindrically shaped with the same circumference along its length in this example embodiment.

The tapered section 10*e* of the mounting end 10*b* of the coupling rod 10 and the cylindrical first section 5*c* of the opening result in a first radial gap between the outer contour of the mounting end 10*b* and the inner contour of the first section 5*c* of the opening. The first gap decreases in size towards the rod shoulder 10*d*. Also the conically shaped second section 5*a* of the opening and the cylindrically shaped section of the coupling rod between the rod shoulder 10*d* and the threaded end 10*a* results in a second radial gap between the inner contour of the first section of the opening and the outer contour of the coupling rod. Again the second gap decreases from the end of the opening towards the abutment shoulder 20*a*. Generally there also can be a little radial play between edges of the rod shoulder and the abutment shoulder relative to the opposing contours.

In FIG. 2 the cable anchorage system of this embodiment is shown in a first position, wherein the anchorage socket 4 is tilted relative to the longitudinal axis of the support socket 20. In this position the mounting end 10*b* of the coupling rod 10 moves within the first gap towards one side of the opening. The rod shoulder 10*d* rests within the circumferential boundaries of the first section 5*c* of the opening, whereby the coupling rod is centred within the opening. Also the section of the coupling rod between rod shoulder and threaded end is declined towards the inner contour of the conically shaped second section 5*a* of the opening. The coupling rod 10 can be tilted in any radial direction within the limits of free play between the inner contour of the opening and the outer contour of the coupling rod. As can be seen in FIG. 2 the axis (zb) of the anchorage socket 4 and the support socket 10 fixed in the anchorage socket 4 is inclined relative to the axis (za) of the support socket 20 and the opening 5. This can occur for example in the case of a misalignment between the cable axis (zb) and the axis of the gusset flange due to construction tolerances.

The first position exists for example after the anchorage socket 4 with the cable 3 has been connected to the coupling rod 10. To do so the counter thread 4*a* is screwed onto the threaded end 10*a* of the coupling rod 10. The radial degree of freedom facilitates the screwing process and results in less stress on the single parts of the cable anchorage system. At the same time the mounting end 10*b* can rotate within the opening 5. The rotational degree of freedom also assists the mounting of the anchorage socket on the coupling rod and therefore the coupling of the cable 3 to the supporting structure 1. The anchorage socket then is fixed to the coupling rod and is hanging within the opening 5 of the support socket 20. In this position the rod shoulder 10*d* abuts against the abutment shoulder 20*a* of the opening. The rod shoulder surface 10*c* may slide on the abutment shoulder 20*a* in this position. The surfaces can be designed convex and concave respectively to enable easy centring and sliding between the coupling rod 10 and the support socket 20. Also the surfaces can be inclined relative to the radial direction as shown in the figure.

In the second position shown in FIG. 3 the axis of the anchorage socket 4 and the coupling rod 10 fixed in the anchorage socket 4 is aligned with the axis of the support socket 20 and the opening 5. The second position exists for example when the cable is well aligned along the axis of the support socket 20 after it has been loaded. The inclined or convex/concave design of the rod shoulder surface 10*c* and the abutment shoulder surface 20*b* helps to align the two axes (za) and (zb).

In the position of FIG. 4 a stressing unit of the cable anchorage system started to tune the cable length and the load on the cable, by pulling the anchorage socket 4 in direction of the support socket 20. The longitudinal cable force is transferred in this position by the stressing unit and not the coupling rod 10.

The stressing unit comprises socket stressing brackets 11, which can be attached into the flanges 8 of the clevis coupler 6. Alternatively they might also be attached directly to the clevis pin 9 for example by providing the pin with an over length and matching reservations in the stressing bracket 11 or by providing the pin with reservations in its end faces into which protrusions of the stressing bracket 11 interlock. Furthermore the stressing unit comprises stressing jacks 14, which are attached to the anchorage socket 4 by stressing jack attachments 13. The stressing jacks 14 and the socket stressing brackets 11 are connected by stressing bars 12. Alternatively other stressing members such as ropes made of high tensile steel, carbon fibre or any other high tensile material may be used instead of the stressing bars 12. The socket stressing brackets make use of the attachment within the flanges 8 to transfer the cable load during operations of cable tension of length adjustment. The stressing bars 12 transfer the force of the cable during force or length adjustment operation between the socket stressing brackets 11 to the stressing jacks 14. The stressing jack attachment 13 transfers the load of the stressing jacks 14 to the cable, through the anchorage socket 4.

The tuning process results in an axial movement of the mounting end 10*b* of the coupling rod 10 within the first section 5*c* of the opening 5. Thus the rod shoulder 10*d* removes from the abutment shoulder 20*a* so that a clearance e is formed between the shoulders 10*d* and 20*a*. The clearance e increases as long as the anchorage socket 4 moves towards the support socket 20. The clearance e can for example be up to 200 mm and preferably up to 50 mm. But the coupling rod 10 can be screwed further into the anchorage socket 4, so that the clearance decreases. Preferably the clearance e is adjusted to be less than 3 mm when the cable anchorage system is in a mounted position. This can be done easily because there is no load on the coupling rod anymore. When the coupling rod 10 moves within the opening 5, the edge of the abutment shoulder 20*a* is guided along the outer contour of the coupling rod 10 and also the edge of the rod shoulder 10*d* is guided along the inner contour of the opening. This helps to stabilize the cable anchorage system during tuning the system.

When the tuning process is completed the force in the stressing system is released by retracting the stressing jacks 14 and the force is transferred to the coupling rod 10 when the rod shoulder 10*d* engages by contacting the abutment shoulder 20*a*. Once the force has been transferred in this manner the stressing unit consisting of stressing jacks 14 and stressing bears 12 and its stressing brackets 11 and stressing jack attachments 13 can be removed.

In FIG. 5 a second embodiment of a cable anchorage system according to the present invention is shown. Parts with same function as in the first embodiment according to FIGS. 2-4 have the same reference numbers. In this embodiment the coupling rod 10 is designed as a longitudinal cylindrical bolt, which is threaded along its full length. The threaded end 10*a* thus extends far into the opening 5 of the support socket 20. The mounting end 10*b* comprises a rod shoulder element 19, which is a separate sleeve-like element. The rod shoulder element 19 comprises an interior thread that corresponds to the male thread of the coupling rod 10. Thus the rod shoulder element 19 can be screwed on the coupling rod 10. One end of the rod shoulder element 19 serves as the rod shoulder. The rod shoulder is designed as a conical surface. The outer contour of the rod shoulder element 19 is tapered relative to the axis of the coupling rod 10. Thus a gap is created between the tapered contour and the inner contour of the opening 5. The cable anchorage system is shown in an aligned position, wherein the rod shoulder 10*d* and the abutment shoulder 20*a* rest on each other. In this embodiment the abutment shoulder 20*a* is part of a further sleeve-like element 20*c* comprising an external thread that screws into an internal thread in the support socket 20.

A cable anchoring system according to the present invention is described according to the embodiments shown in the FIGS. 2 to 4 and 5. But it is clear to a person skilled in the art, that specific features of the cable anchoring system can be realized by alternatives as mentioned in the general description above. First of all the opening can be realized in the anchorage socket instead of the support socket and the counter thread can be located on the support socket instead of the anchorage socket. Furthermore alternative variations for the design of the rod shoulder or the abutment shoulder are possible as long as the coupling rod abuts within the opening. Also instead of a clevis coupler other coupling elements are possible.

| Reference Numbers | |
|---|---|
| 1 | supporting structure |
| 2 | gusset flange |
| 3 | cable |
| 3a | cable strands |
| 4 | anchorage socket |
| 4a | counter thread |
| 5 | opening |
| 5a | second section of opening |
| 5c | first section of opening |
| 6 | clevis coupler |
| 7 | protrusion |
| 8 | flange |
| 9 | clevis pin |
| 10 | coupling rod |
| 10a | threaded end |

-continued

| Reference Numbers | |
|---|---|
| 10b | mounting end |
| 10c | rod shoulder surface |
| 10d | rod shoulder |
| 10e | tapered section |
| 11 | socket stressing brackets |
| 12 | stressing bars |
| 13 | stressing jack attachment |
| 14 | stressing jacks |
| 15 | anti vandalism pipe |
| 16 | receiving hole |
| 19 | rod shoulder element |
| 20 | support socket |
| 20a | abutment shoulder |
| 20b | abutment shoulder surface |
| 20c | sleeve-like element |
| e | clearance |
| za | opening axis |
| zb | coupling rod axis |

The invention claimed is:

1. Cable anchorage system for anchoring a cable to a support structure comprising an anchorage socket attached to the cable, a support socket attached to the support structure and a longitudinal coupling rod, which couples the anchorage socket to the support socket, wherein the coupling rod comprises a threaded end, which interacts with a counter thread on one of the anchorage socket and the support socket, and a mounting end with a radially extending rod shoulder, the other one of the anchorage socket and the support socket comprises a longitudinal opening for receiving the mounting end of the coupling rod, which opening comprises an inwardly extending abutment shoulder, wherein the rod shoulder abuts on the abutment shoulder in a first longitudinal direction and is slideable within the opening in a second longitudinal direction opposite to the first direction.

2. Cable anchorage system according to claim 1, wherein the coupling rod is supported within the opening in a rotatable fashion about a longitudinal axis of the opening.

3. Cable anchorage system according to claim 1, wherein the coupling rod is supported within the opening in a slewable fashion relative to a longitudinal axis of the opening.

4. Cable anchorage system according to claim 1, wherein the radially extending rod shoulder of the mounting end of the coupling rod runs circumferentially around an outer contour of the coupling rod and/or the inwardly extending abutment shoulder runs circumferentially around an inner contour of the opening.

5. Cable anchorage system according to claim 1, wherein the mounting end of the coupling rod comprises a circumferentially tapered section extending from the rod shoulder to the mounting end of the coupling rod and/or the abutment shoulder of the opening is of conical shape, which opens in direction of the mounting end.

6. Cable anchorage system according to claim 1, wherein an inner contour of the opening comprises a second section from the abutment shoulder towards the threaded end of the coupling rod, wherein the second section is of conical shape, which opens in direction of the threaded end.

7. Cable anchorage system according to claim 1, wherein a surface of the rod shoulder comprises a convex shape.

8. Cable anchorage system according to claim 1, wherein the support socket is connected to a clevis coupler, which is coupled to the support structure.

9. Cable anchorage system according to claim 5, wherein, when the coupling rod slides within the opening, an inner contour of the first section of the opening is a longitudinal guide of an outer edge of the rod shoulder and/or an outer contour of the coupling rod between rod shoulder and threaded end is a longitudinal guide of an inner edge of the abutment shoulder.

10. Cable anchorage system according to claim 1, wherein, the rod shoulder is on a separate rod shoulder element mounted on the coupling rod.

11. Cable anchorage system according to claim 1, wherein the system comprises a stressing unit for moving the anchorage socket towards the support socket, wherein the stressing unit comprises at least one stressing jack attachable to the anchorage socket and socket stressing brackets attachable to the support socket or a clevis pin.

12. Civil engineering construction comprising at least one cable, which is attached to a supporting structure of the construction at least on one end by the cable anchorage system according to claim 1.

13. Method for tuning the cable anchorage system according to claim 1 by a stressing unit, wherein the stressing unit comprises at least one stressing jack attached to the anchorage socket and socket stressing brackets attached to the support socket, wherein the stressing unit moves the anchorage socket towards the support socket, while the mounting end of the coupling rod slides longitudinally within the opening.

14. Method for tuning a cable anchorage system according to claim 13, wherein a force to stress the cable is transmitted from the support socket by the socket stressing brackets and the stressing jacks to the anchorage socket.

* * * * *